US012252367B2

(12) United States Patent
Iwanaga

(10) Patent No.: US 12,252,367 B2
(45) Date of Patent: Mar. 18, 2025

(54) SINGLE-SHEET LIFTER

(71) Applicant: AMADA CO., LTD., Kanagawa (JP)

(72) Inventor: Hiroshi Iwanaga, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 125 days.

(21) Appl. No.: 18/020,930

(22) PCT Filed: Sep. 6, 2021

(86) PCT No.: PCT/JP2021/032639
§ 371 (c)(1),
(2) Date: Feb. 11, 2023

(87) PCT Pub. No.: WO2022/054756
PCT Pub. Date: Mar. 17, 2022

(65) Prior Publication Data

US 2023/0286174 A1 Sep. 14, 2023

(30) Foreign Application Priority Data

Sep. 11, 2020 (JP) ..... 2020-153045

(51) Int. Cl.
*B65H 3/08* (2006.01)
*B65H 3/48* (2006.01)

(52) U.S. Cl.
CPC ..... *B65H 3/0816* (2013.01); *B65H 3/0833* (2013.01); *B65H 3/48* (2013.01); *B65H 2701/173* (2013.01)

(58) Field of Classification Search
CPC .. B65H 3/0816; B65H 3/0825; B65H 3/0833; B65H 3/0841; B65H 3/48;
(Continued)

(56) References Cited

U.S. PATENT DOCUMENTS 5,676,364 A * 10/1997 Shiiki ..... B65H 3/0816 271/106
5,967,508 A * 10/1999 Olexy ..... B65H 5/10 271/106

FOREIGN PATENT DOCUMENTS

CN 208131849 U 11/2018
JP 48-9469 A 2/1973
(Continued)

OTHER PUBLICATIONS

Extended European Search Report for corresponding EP Application No. 21866715.2 dated Feb. 9, 2024.
(Continued)

*Primary Examiner* — Jeremy R Severson
(74) *Attorney, Agent, or Firm* — Renner, Otto, Boisselle & Sklar, LLP

(57) ABSTRACT

A single-sheet lifter includes a base frame arranged in a vicinity of a loading area and extending vertically, a separation unit configured to separate an uppermost workpiece from a plurality of the workpieces loaded in the loading area by means of at least one of an injection pressure of air and a suction force, and a counter balancer configured to reduce a weight acting on the separation unit. The separation unit is provided to the base frame so as to be able to move up and down. The separation unit includes a contact member that comes into contact with a surface of the uppermost workpiece. The separation unit is configured to go up following a lifting operation of a workpiece suction lifter and be retracted from above the loading area when the workpiece suction lifter sucks the surface of the uppermost workpiece to lift the workpiece.

6 Claims, 10 Drawing Sheets

(58) Field of Classification Search
CPC ..... B65H 2406/34; B65H 2406/341; B65H 2406/342; B65H 2406/344; B65H 2406/345; B65H 2406/3452; B65H 2406/34525; B65H 2406/3454; B65H 2406/364
See application file for complete search history.

(56) References Cited

FOREIGN PATENT DOCUMENTS

| | | | |
|---|---|---|---|
| JP | 56-154939 | U1 | 11/1981 |
| JP | 59-17434 | A | 1/1984 |
| JP | 5-42245 | U1 | 6/1993 |
| JP | 8-119480 | A | 5/1996 |
| JP | 2016-112608 | A | 6/2016 |
| JP | 2017-124469 | A | 7/2017 |
| JP | 2017-149496 | A | 8/2017 |

OTHER PUBLICATIONS

International Search Report for corresponding Application No. PCT/JP2021/032639, mailed Nov. 16, 2021.
Written Opinion for corresponding Application No. PCT/JP2021/032639, mailed Nov. 16, 2021.

* cited by examiner

SINGLE-SHEET LIFTER

TECHNICAL FIELD

The present invention relates to a single-sheet lifter for lifting a single sheet of an uppermost workpiece among a plurality of the workpieces (sheet metals) loaded in a loading area.

BACKGROUND ART

When a plurality of workpieces loaded in a loading area are sequentially supplied to a working machine such as a press brake by a loading machine such as a supply robot, a magnet floater installed in a vicinity of the loading area is used. The magnet floater makes it easier to separate the uppermost workpiece by levitating, with a magnetic force, several upper workpieces among the loaded in the loading area (see plurality of workpieces Patent Literature 1 described below). When the workpiece is a non-magnetic body, it is not possible to levitate the workpieces with the magnetic force, and it is difficult to separate only the uppermost workpiece by a workpiece suction lifter of the loading machine.

An air separator installed in the vicinity of the loading area may be used. The air separator separates the uppermost workpiece among the plurality of workpieces loaded in the loading area with a jet pressure of air (see Patent Literature 2 described below). The air separator includes a base frame installed in the vicinity of the loading area and extending vertically, and a separation unit provided to the base frame so as to be able to move up and down. The uppermost workpiece is separated from other workpieces by the pressure of the air injected from the separation unit. The separation unit includes a contact member that comes into contact with the surface of the uppermost workpiece and a nozzle for injecting the air toward the edge of the uppermost workpiece. When the workpiece suction lifter of the loading machine sucks the surface of the uppermost workpiece to lift the workpiece, the separation unit goes up following the lifting operation of the workpiece suction lifter and is retracted from above the loading area. When the separation unit retracted from above the loading area falls due to its own weight, the separation unit returns to a position above the plurality of workpieces loaded in the loading area.

Note that in addition to Patent Literatures 1 and 2, Patent Literature 3 described below also discloses a technique related to the present invention. Patent Literature 3 relates to an improvement of the workpiece suction lifter.

CITATION LIST

Patent Literature

Patent Literature 1: Japanese Patent Application Laid-Open Publication No. 2016-112608

Patent Literature 2: Japanese Patent Application Laid-Open Publication No. 2017-149496

Patent Literature 3: Japanese Patent Application Laid-Open Publication No. 2017-124469

SUMMARY

If the air separator is used, the weight of the separation unit becomes large. If the weight of the separation unit is large, the workpiece loaded in the loading area may be scratched due to the impact when the separation unit falls.

Further, if the rigidity of the workpiece is small, the vicinity of the edge of the workpiece may be deflected and plastically deformed by the pressure of the air when the workpiece suction lifter lifts the uppermost workpiece. Regarding the air separator, an improvement is desired in stably lifting the uppermost workpiece while preventing the workpiece from being damaged.

An object of the present invention is to provide a single-sheet lifter capable of stably lifting the uppermost workpiece while preventing the workpiece from being damaged.

According to one aspect of the present invention, there is provided a single-sheet lifter including a base frame arranged in a vicinity of a loading area and extending vertically, a separation unit provided to the base frame so as to be able to move up and down (move vertically), the separation unit including a contact member that comes into contact with a surface of an uppermost workpiece among a plurality of the workpieces loaded in the loading area, the separation unit being configured to go up following a lifting operation (an ascending operation) of a workpiece suction lifter of a loading machine and be retracted from above the loading area when the workpiece suction lifter sucks the surface of the uppermost workpiece to lift the workpiece, and configured to separate the uppermost workpiece from other workpieces by means of at least one of an injection pressure of air and a suction force, and a counter balancer configured to reduce a weight acting on the separation unit.

The single-sheet lifter may further include a first rotating wheel provided to the base frame so as to be able to rotate, a second rotating wheel provided to the base frame so as to be able to rotate and move up and down, and a linear or band-shaped connecting member including one end connected to the separation unit and another end connected to the base frame, the connecting member being hung around the first rotating wheel, and hung around the second rotating wheel so as to suspend the second rotating wheel. In this case, the counter balancer is configured to apply a downward force to the second rotating wheel.

The separation unit may include a bellows type suction pad for sucking a surface in a vicinity of an edge of the uppermost workpiece. In this case, the separation unit is configured to lift up the edge of the uppermost workpiece using the contact member as a fulcrum when the suction pad executes a sucking operation in a state in which the contact member is in contact with the surface of the uppermost workpiece. Further, the separation unit may include a nozzle for injecting the air toward the edge of the uppermost workpiece.

The single-sheet lifter may further include an assist unit for assisting a falling operation (a descending operation) due to an own weight of the separation unit that is retracted from the upper side of the loading area. Further, the contact member may be a contact roller rotatable around a horizontal axial center of rotation.

DESCRIPTION OF EMBODIMENT

Figure 1:
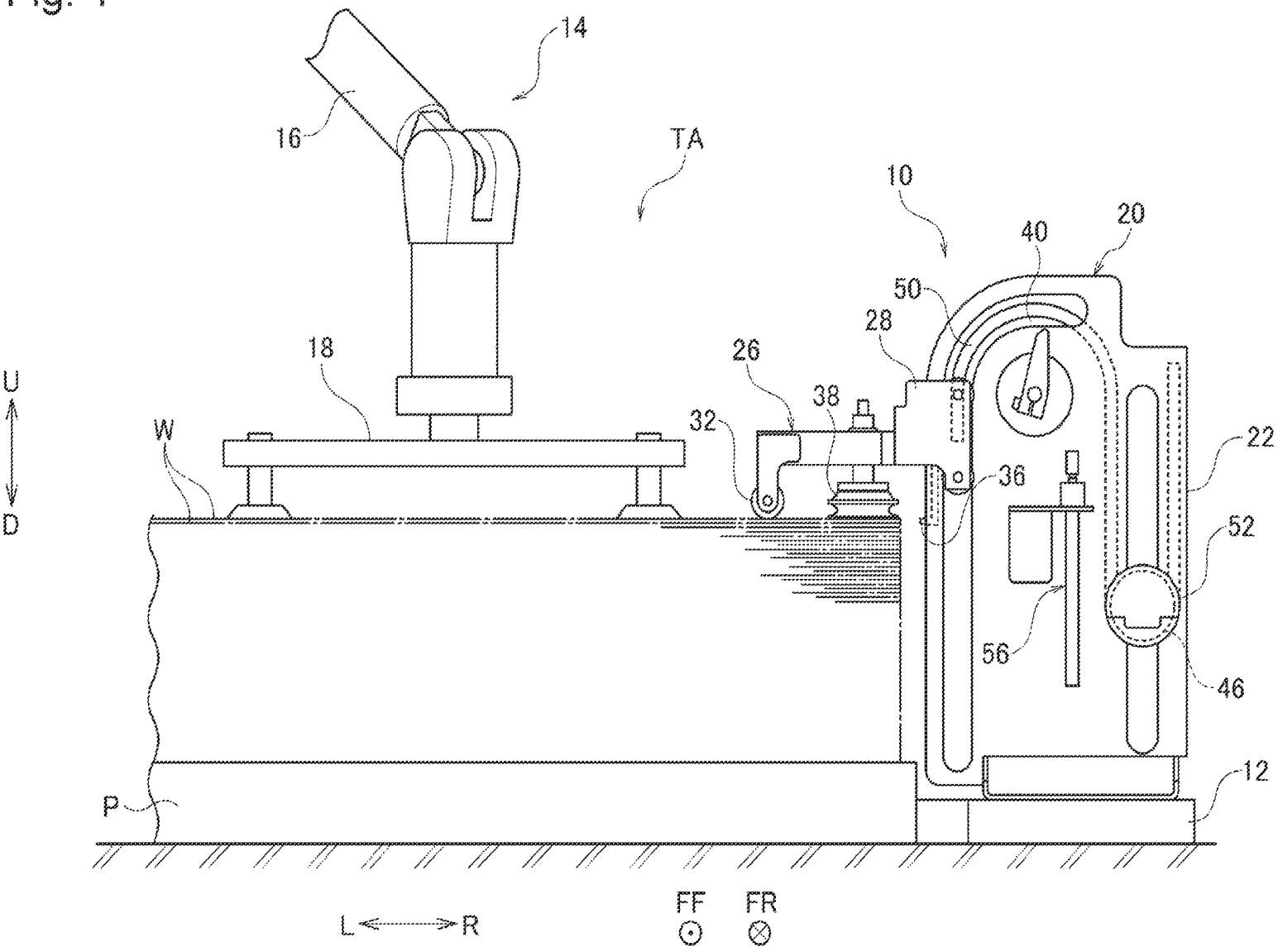
FIG. 1 is a front view in a vicinity of a loading area including a single-sheet lifter according to the present embodiment.

Hereinafter, a single-sheet lifter 10 according to an embodiment will be described with reference to the drawings.

A "loading area" refers to a three-dimensional area for loading a plurality of workpieces (sheet metals). "FF", "FR", "L", "R", "U", and "D" in the drawings refer to a forward direction, a backward direction, a left direction, a right direction, an upper direction, and a downward direction, respectively.

Figure 2:
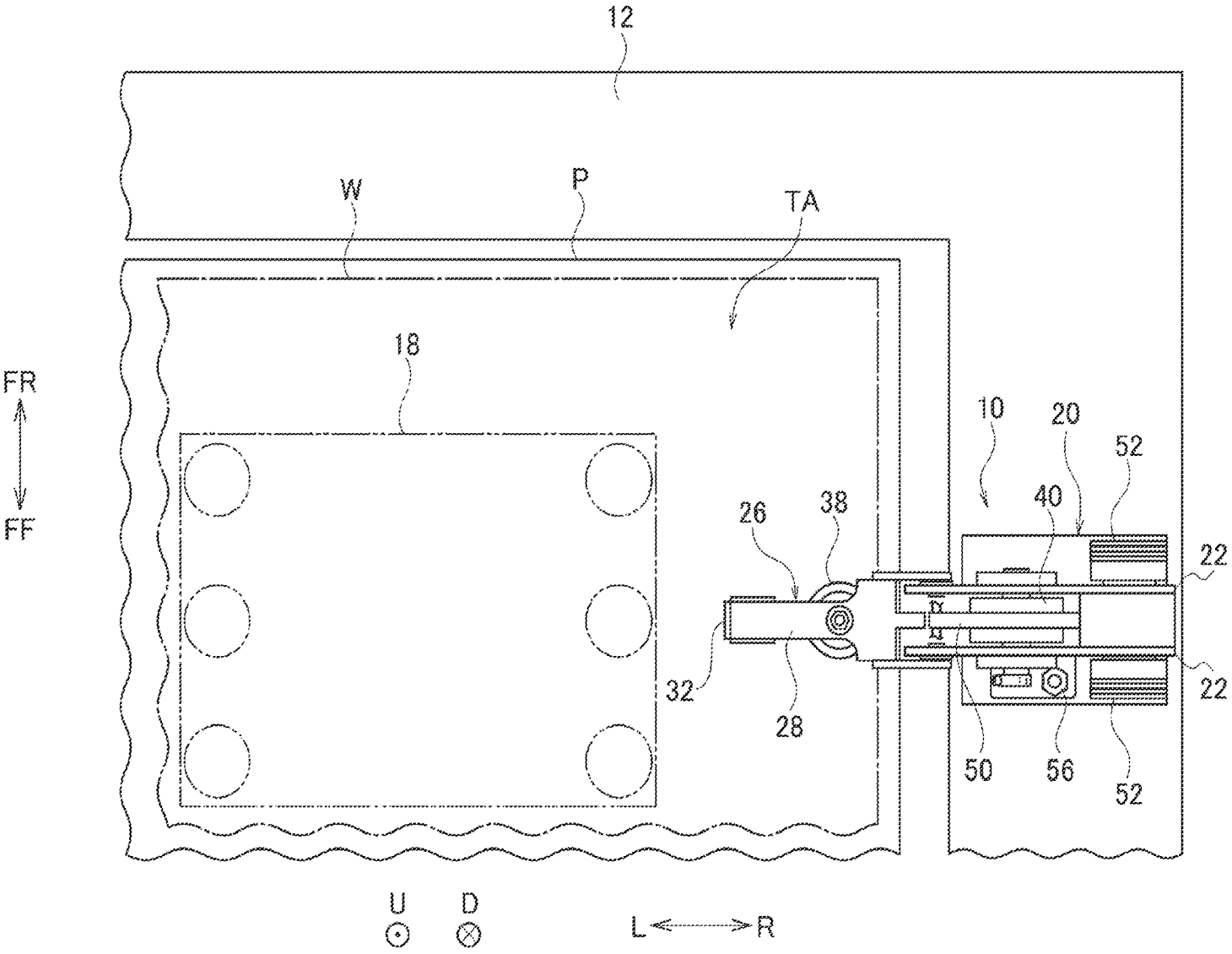
FIG. 2 is a plan view in the vicinity of the loading area described above.
Figure 3:
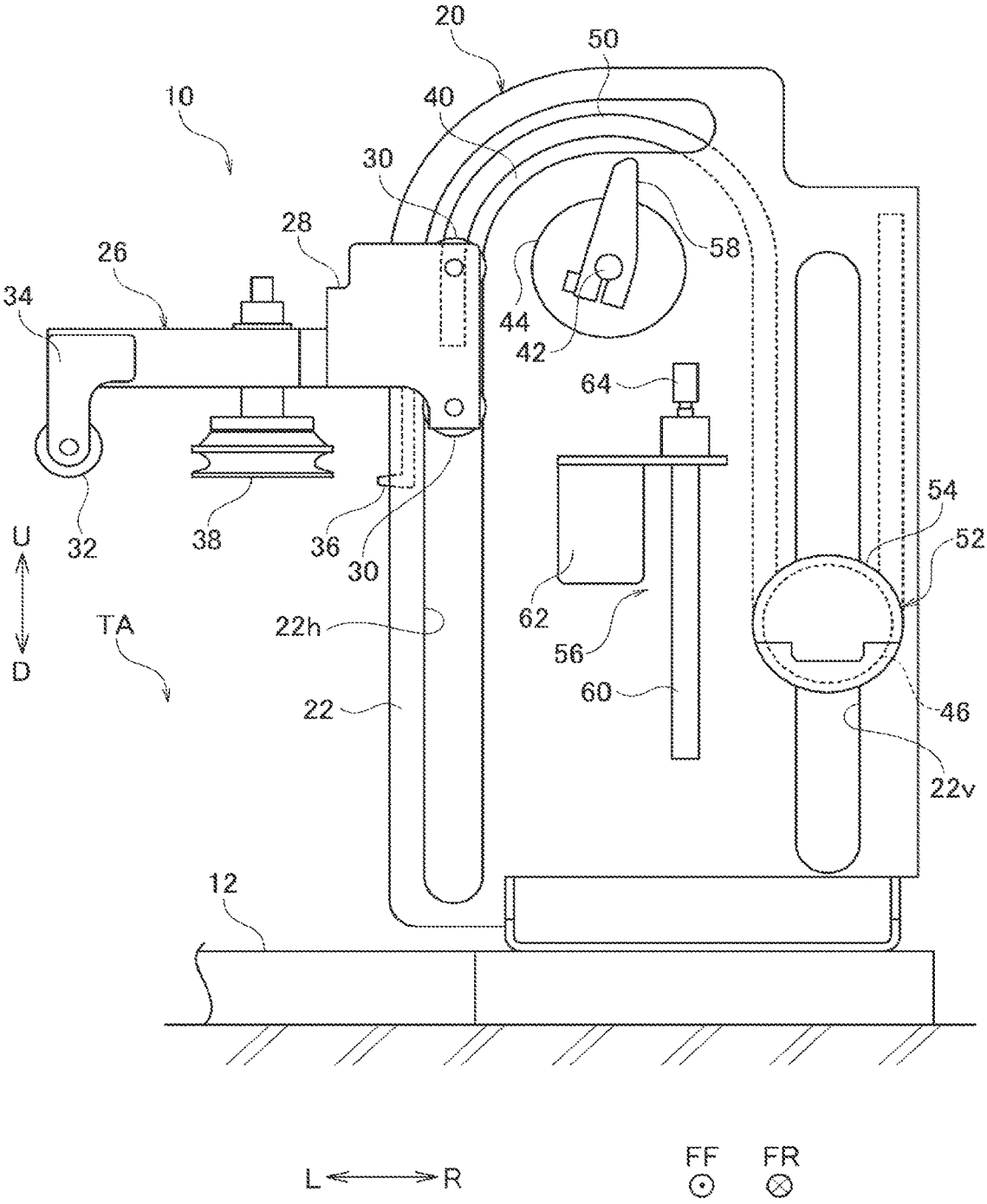
FIG. 3 is a front view of the single-sheet lifter described above.
Figure 4:
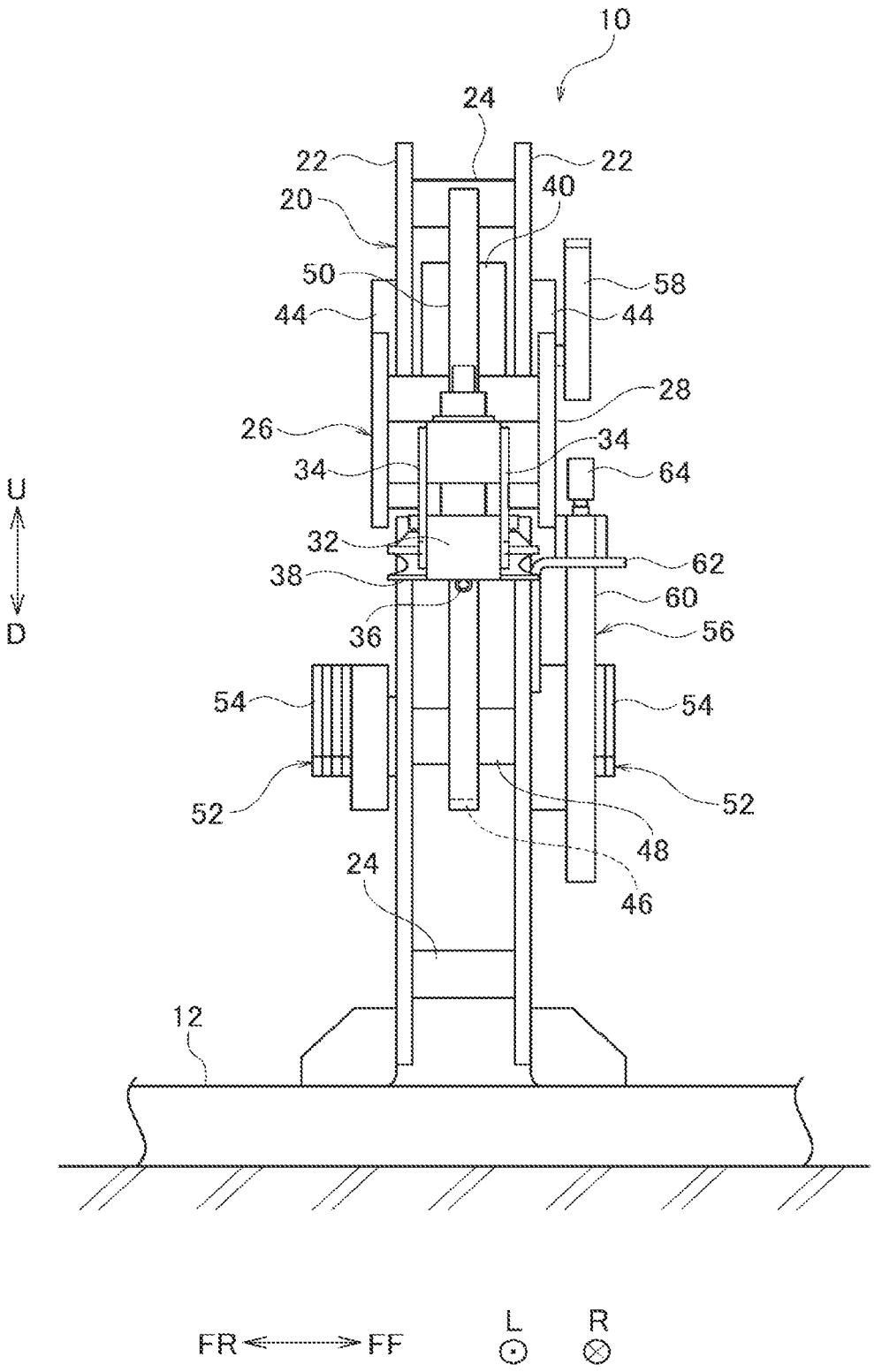
FIG. 4 is a left side view of the single-sheet lifter described above.
Figure 5:
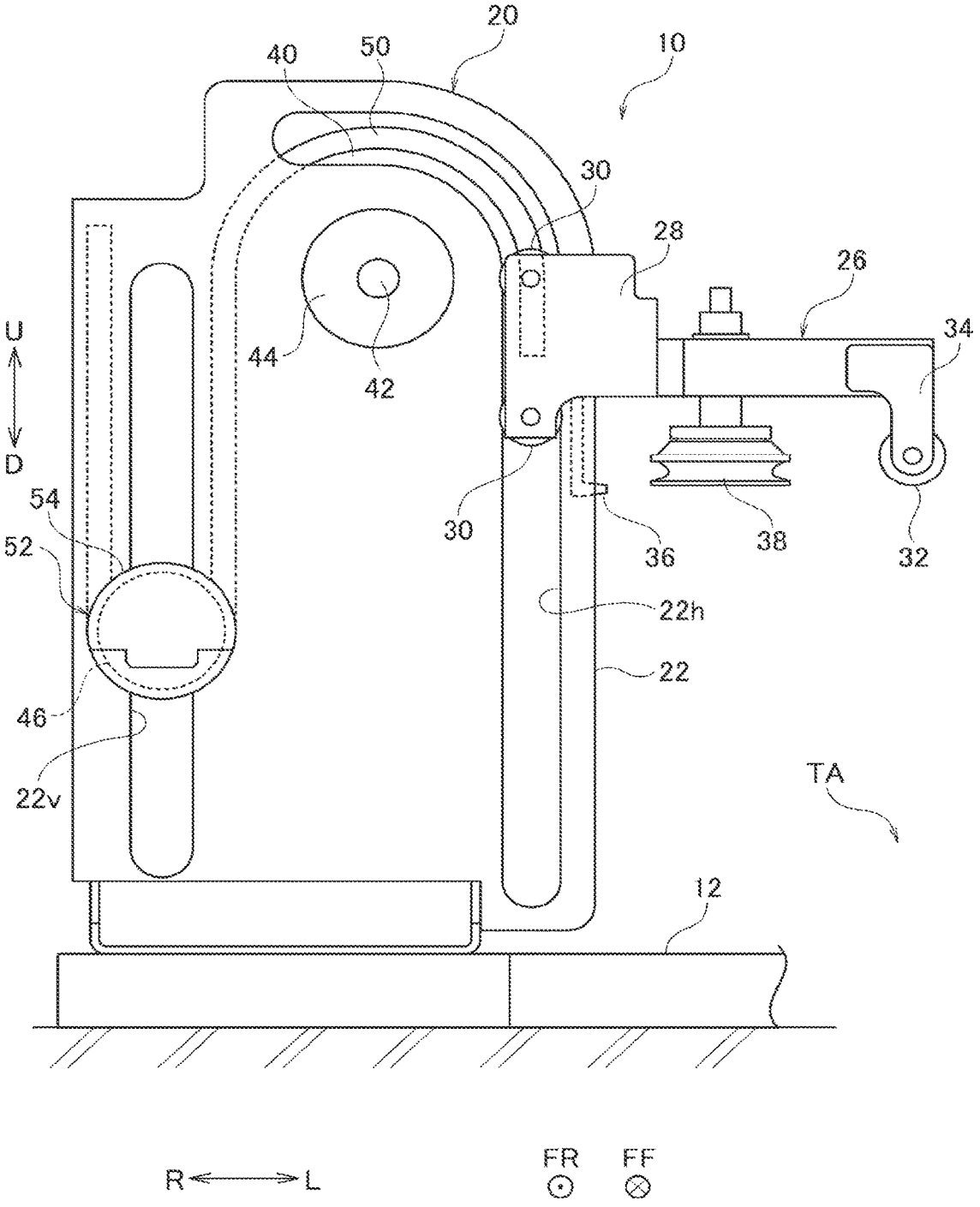
FIG. 5 is a rear view of the single-sheet lifter described above.
Figure 6:
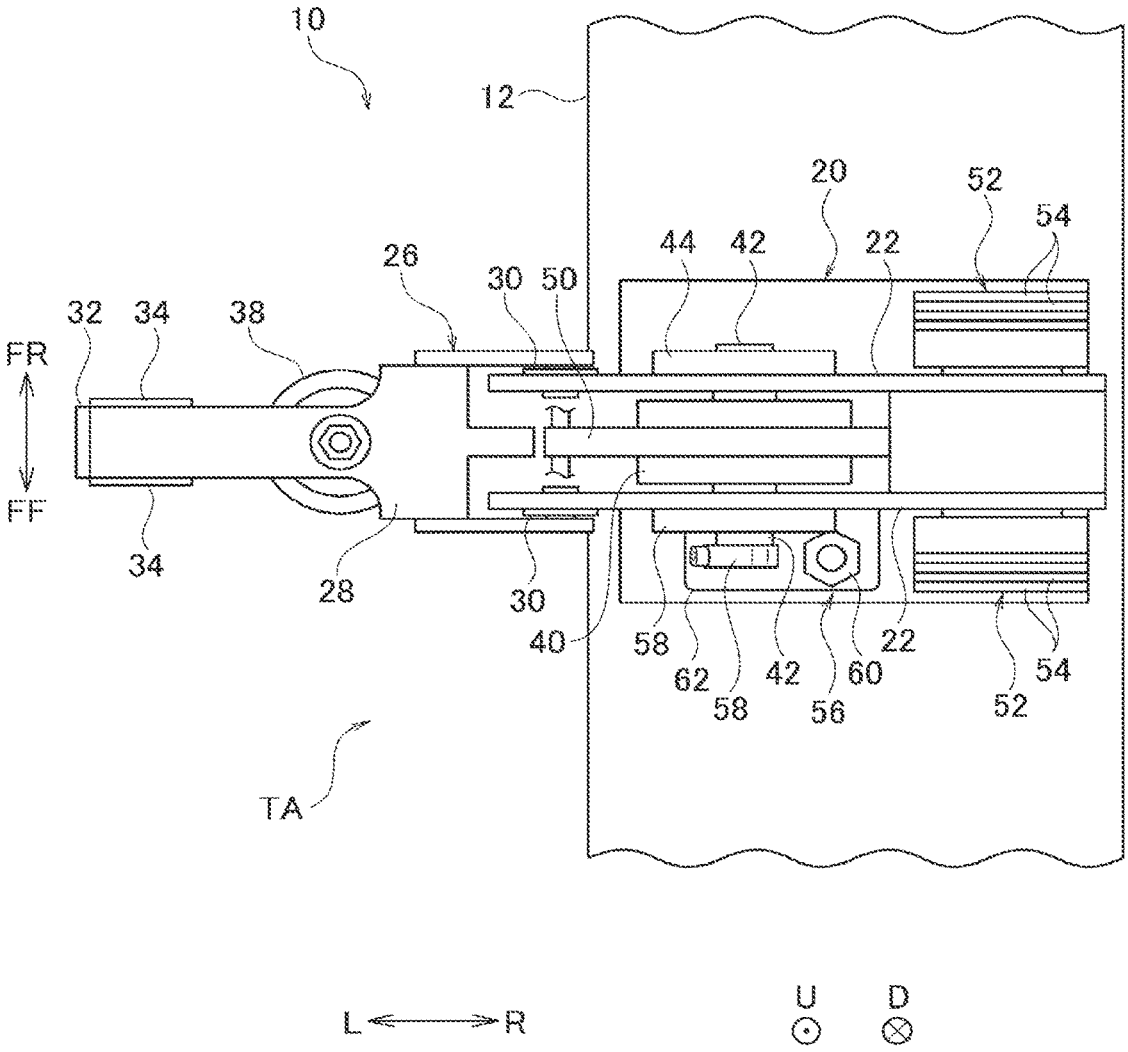
FIG. 6 is a plan view of the single-sheet lifter described above.

As shown in FIGS. 1 and 2, the single-sheet lifter 10 is a machine for lifting only an uppermost workpiece W among a plurality of the plate-shaped workpieces W loaded on a pallet P placed in a loading area TA. The single-sheet lifter 10 is installed on an L-shaped installation table 12 in a plan view provided in a vicinity of the loading area TA, and is located on the right side of the loading area TA. The single-sheet lifter 10 is a kind of air separator that separates the uppermost workpiece W by means of an injection pressure of air. The single-sheet lifter 10 is used when the plurality of workpieces W loaded on the pallet P in the loading area TA are sequentially supplied to a press brake (not shown) by a supply robot 14.

The supply robot 14 is a kind of loading machine that supplies the workpieces W to the press brake. The supply robot 14 has, for example, the configuration disclosed in Patent Literature 3. The supply robot 14 includes an articulated robot arm 16 and a robot hand 18 as a workpiece suction lifter for sucking the workpiece W, which is attached to the tip of the robot arm 16. The press brake is a working machine that bends the workpiece W, and is installed behind the loading area TA. On the right side of the loading area TA, in addition to the single-sheet lifter 10, a double-sheet lifting detection machine (not shown) is also installed. The double-sheet lifting detection machine detects whether or not the robot hand 18 has sucked two or more workpieces W.

As shown in FIGS. 3 to 6, the single-sheet lifter 10 includes a base frame 20 arranged on the installation table 12. The base frame 20 extends vertically. The base frame 20 includes a pair of support plates 22 that are separated and opposed to each other in the front-rear direction, and a plurality of spacers 24 that connect the two support plates 22. A first guide elongated hole **22*h* extending vertically is formed on each of the support plates 22. The upper portion of the first guide elongated hole 22*h* is curved so as to be away from the loading area TA. A second guide elongated hole 22*v* extending vertically is formed on the right side of the first guide elongated hole 22*h***.

A separation unit 26 that separates the uppermost workpiece W from other workpieces W by means of the injection pressure of air and the suction force is provided to the base frame 20 so as to be able to move up and down (move vertically). The specific configuration of the separation unit 26 will be described below.

The separation unit 26 includes a unit main body 28 provided to the base frame 20 so as to be able to move up and down. The unit main body 28 projects in a cantilevered manner with respect to the base frame 20. At the base end of the unit main body 28, two pairs of guide rollers 30 with flanges are rotatably provided around a horizontal axial center of rotation thereof. The guide rollers 30 in each of the pair are separated and opposed to each other in the front-rear direction. Each of the guide roller 30 is guided and supported by the first guide elongated hole **22*h***.

At the tip of the unit main body 28, a contact roller 32 as a contact member that comes into contact with the surface of the uppermost workpiece W from above is provided via a pair of brackets 34. The contact roller 32 is rotatable around a horizontal axial center of rotation thereof, and is made of an elastic material such as urethane. A nozzle 36 for injecting air toward an edge of the uppermost workpiece W is provided in a vicinity of the base end of the unit main body 28. The nozzle 36 is connected to an air supplying source (not shown) such as a supply pump that supplies the air.

A bellows type suction pad 38 for sucking a surface in a vicinity of the edge of the uppermost workpiece W from above is provided in the middle part of the unit main body 28. The suction pad 38 is connected to an air suctioning source (not shown) such as a vacuum pump for sucking air. The suction pad 38 comes into contact with the surface of the uppermost workpiece W prior to the contact roller 32. The separation unit 26 is configured to lift up the edge of the uppermost workpiece W using the contact roller 32 as a fulcrum when the suction pad 38 executes a sucking operation in a state in which the contact roller 32 is in contact with the surface of the uppermost workpiece W (see FIG. 7A).

The separation unit 26 is configured to go up following a lifting operation (an ascending operation) of the robot hand 18 and be retracted from above the loading area TA when the robot hand 18 lifts the uppermost workpiece W. Further, when the separation unit 26 retracted from above the loading area TA falls due to its own weight, the separation unit 26 returns to the position above the plurality of workpieces W loaded in the loading area TA via the pallet P.

Note that either the nozzle 36 or the suction pad 38 may be omitted from the separation unit 26. In this case, the separation unit 26 separates the uppermost workpiece W from the other workpieces W by means of either the injection pressure of the air or the suction force.

At the upper part between the pair of support plates 22, a first sprocket 40 as a rotating wheel is rotatably provided around a horizontal axial center of rotation thereof. Each end portion of a rotating shaft 42 of the first sprocket 40 is rotatably supported at the upper part of the support plate 22 via a support ring 44. The first sprocket 40 is not able to move up and down with respect to the support plate 22. Further, on the right side of the first sprocket 40 in the base frame 20, a second sprocket 46 as a second rotating wheel is provided so as to be able to move up and down, and rotate around a horizontal axial center of rotation thereof. Each end portion of a rotating shaft 48 of the second sprocket 46 is supported by the second guide elongated hole **22*v* of the support plate 22** so as to be able to rotate and move up and down.

A connecting chain 50 as a linear connecting member is provided between the pair of support plates 22. One end of the connecting chain 50 is connected to the base end of the separation unit 26. The other end of the connecting chain 50 is connected to the upper right portion of the base frame 20. The vicinity of the one end of the connecting chain 50 is hung around the first sprocket 40. The vicinity of the other end of the connecting chain 50 is hung around the second sprocket 46 so as to suspend the second sprocket 46.

Instead of respectively using the first sprocket 40 and the second sprocket 46 as the first and second rotating wheels, a first pulley (not shown) and a second pulley (not shown) may be used as the first and second rotating wheels, respectively. In this case, instead of using the connecting chain 50 as the linear connecting member, a connecting belt (not shown) is used as a band-shaped connecting member.

A counter balancer 52 that reduces a weight acting on the separation unit 26 is provided at each end portion of the rotating shaft 48 of the second sprocket 46. Each of the counter balancers 52 includes a plurality of weights 54 that apply gravity as a downward force to the second sprocket 46. The counter balancer 52 is configured to be rotatable with respect to the support plate 22. That is, the counter balancer 52 is configured to be rotatable relative to the rotating shaft 48 of the second sprocket 46.

In lieu of the counter balancer 52 that includes the plurality of weights 54, as another counter balancer that reduces the weight acting on the separation unit 26, a coil spring (not shown) that applies an urging force as the downward force to the second sprocket 46 may be used. In this case, the coil spring is provided between each end portion of the rotating shaft 48 of the second sprocket 46 and the support plate 22.

The single-sheet lifter 10 includes an assist unit 56 for assisting a falling operation (a descending operation) due to the own weight of the separation unit 26 that is retracted from above the loading area TA. The specific configuration of the assist unit 56 will be described below.

The base end of a swing lever 58 is integrally connected to one end of the rotating shaft 42 of the first sprocket 40. An air cylinder 60 as an assist actuator is attached via a bracket 62 to the support plate 22 on the front side. The air cylinder 60 includes an operation rod 64 that can move vertically. The assist unit 56 is configured such that the air cylinder 60 is driven to cause the operation rod 64 to push the tip of the swing lever 58 from below, which is applied to the first sprocket 40 for promoting the falling operation of the separation unit 26.

Subsequently, the operation and effect of the single-sheet lifter 10 will be described.

(Overall Operation of the Single-Sheet Lifter 10 and the Supply Robot 14)

Figure 7A:
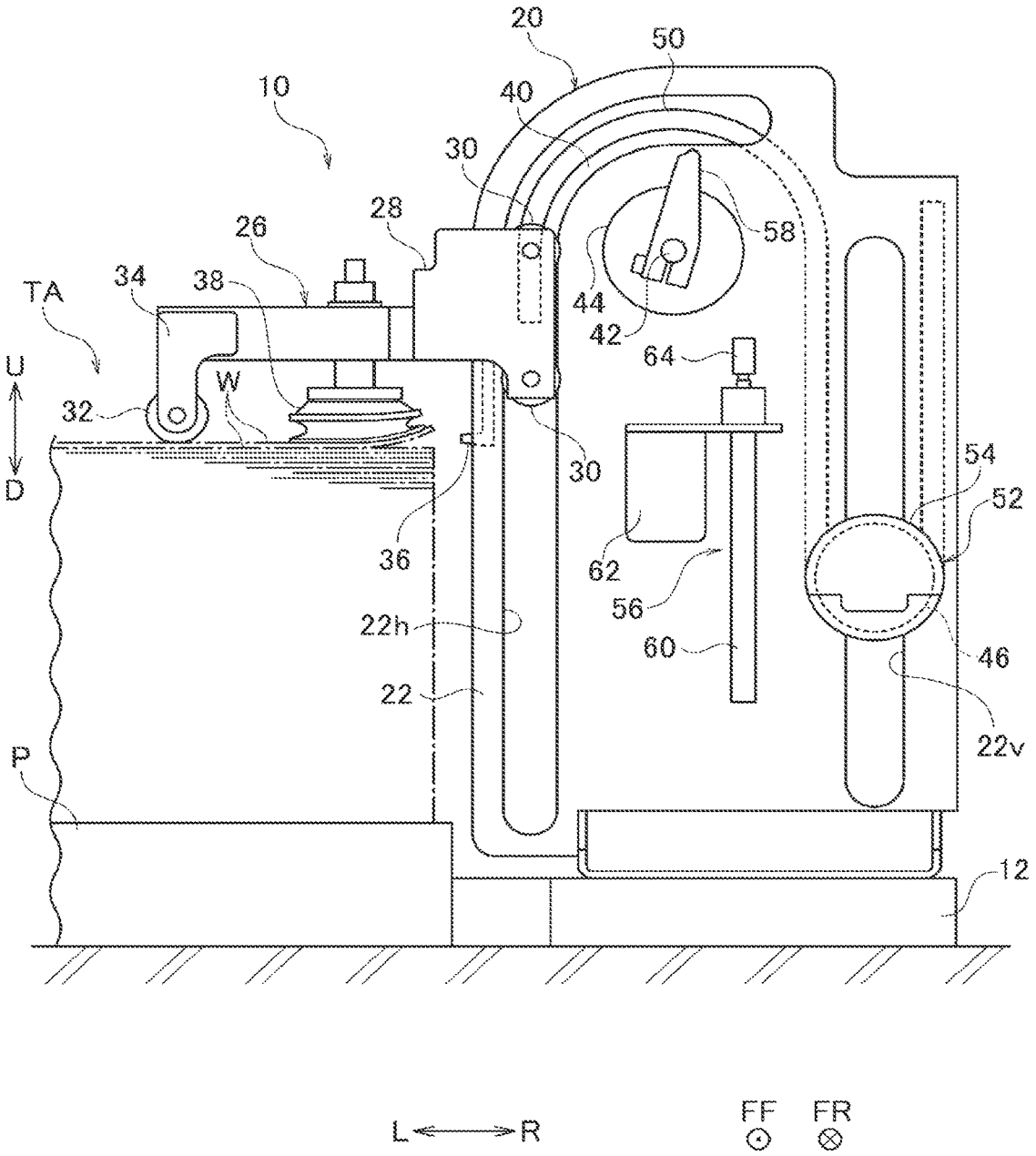
FIG. 7A is a diagram illustrating an operation of the single-sheet lifter described above (a state in which an edge of a workpiece at the top part is being lifted up).

As shown in FIGS. 1 and 7A, by causing the robot hand 18 to go down in the loading area TA, the surface of the uppermost workpiece W is sucked by the robot hand 18. Then, by executing the sucking operation of the suction pad 38 in a state in which the contact roller 32 is in contact with the surface of the uppermost workpiece W, the edge of the uppermost workpiece W is lifted up using the contact roller 32 as a fulcrum. Further, the air is injected from the nozzle 36 toward the edge of the uppermost workpiece W. As the result of this, the uppermost workpiece W is separated from the other workpieces W by means of the injection pressure of the air and the suction force, which makes it possible for the robot hand 18 to easily lift only the uppermost workpiece W. After the uppermost workpiece W is lifted, the sucking operation of the suction pad 38 and the injecting operation of the air from the nozzle 36 are stopped.

Figure 7B:
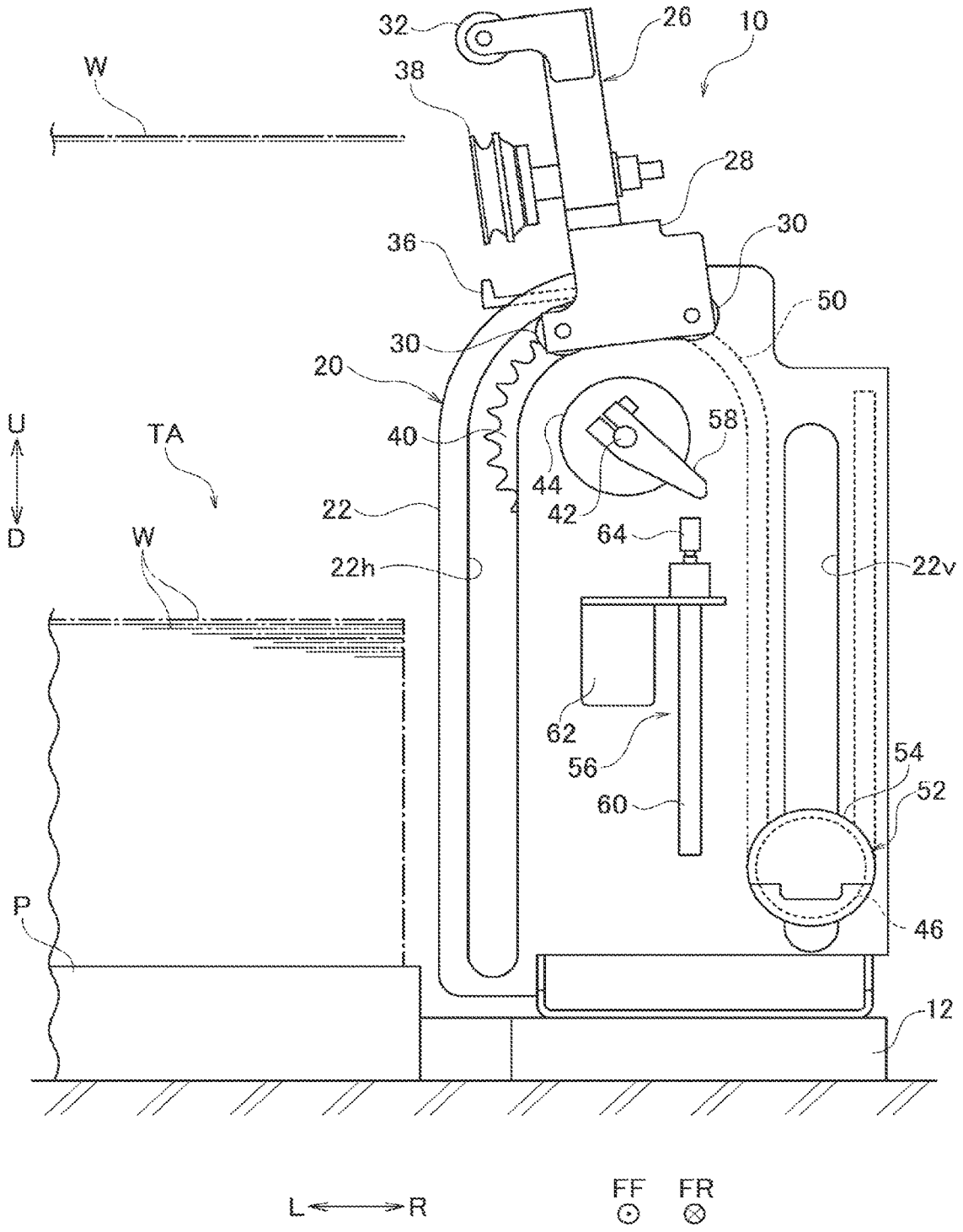
FIG. 7B is a diagram illustrating an operation of the single-sheet lifter described above (a state in which a separation unit is retracted from above the loading area).

As shown in FIG. 7B, when the robot hand 18 is caused to go up to lift the uppermost workpiece W, the separation unit 26 is also caused to go up following the lifting operation of the robot hand 18, and is guided by the first guide elongated hole 22*h* and retracted from above the loading area TA. As a result of this, the workpiece W sucked by the robot hand 18 of the supply robot 14 is supplied to the press brake without being hindered by the separation unit 26.

Figure 7C:
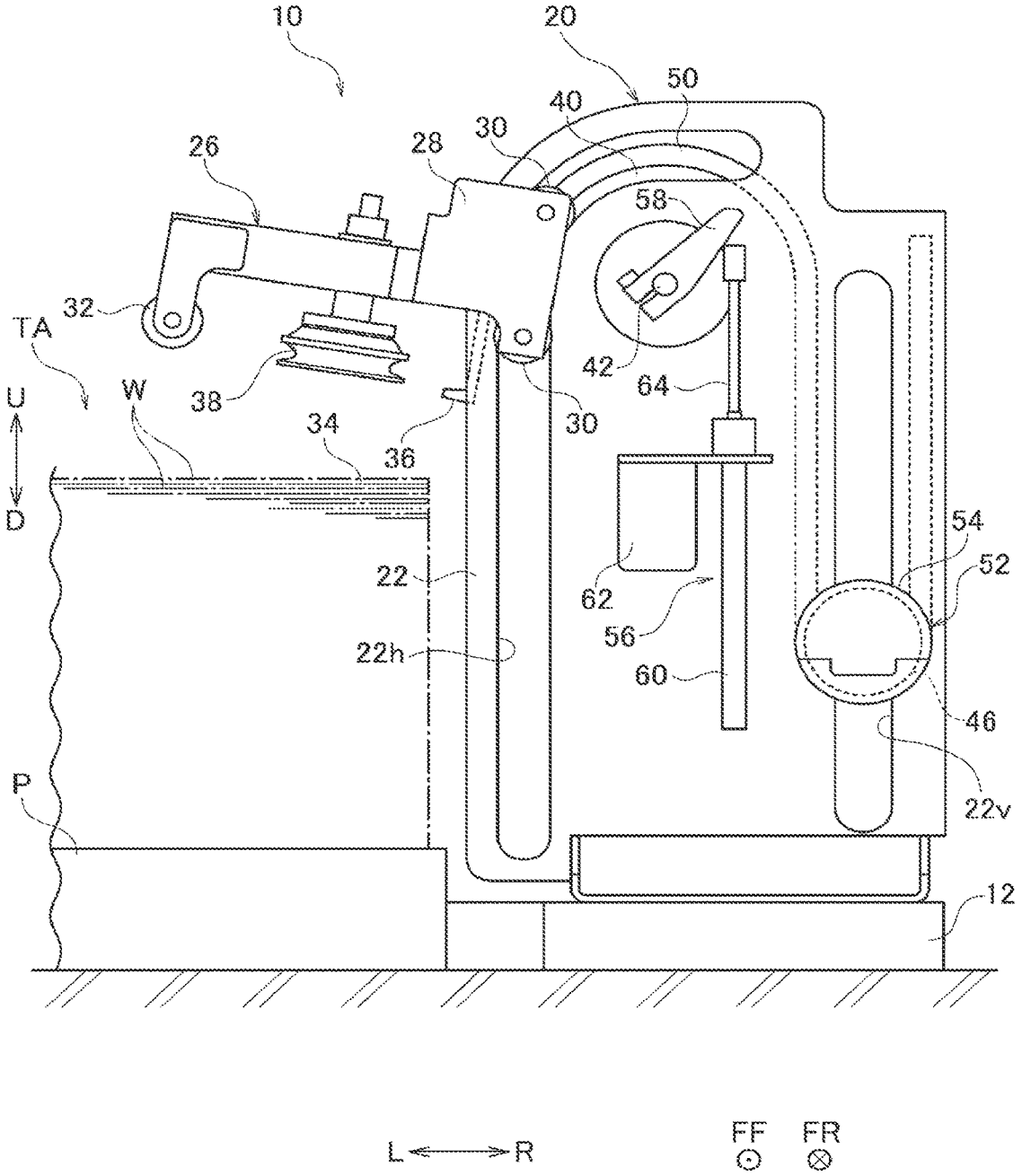
FIG. 7C is a diagram illustrating an operation of the single-sheet lifter described above (a state in which an operation rod presses a tip of a swing lever from below).

After the separation unit 26 is retracted from above the loading area TA, the air cylinder 60 is driven to cause the operation rod 64 to press the tip of the swing lever 58 from below, as shown in FIG. 7C. As the result of this, a rotational force that promotes the falling operation of the separation unit 26 is applied to the first sprocket 40. The separation unit 26 falls due to its own weight and returns to the position above the plurality of workpieces W loaded in the loading area TA.

By repeating the operations described above, the plurality of workpieces W loaded in the loading area TA can be sequentially supplied to the press brake by the supply robot 14.

(Particular Effect of the Single-Sheet Lifter 10)

The separation unit 26 is configured to lift up the edge of the uppermost workpiece W using the contact roller 32 as a fulcrum when the suction pad 38 executes the sucking operation in a state in which the contact roller 32 is in contact with the surface of the uppermost workpiece W. This makes it possible for the uppermost workpiece W to be easily separated from the other workpieces W. As a result, it is possible for the robot hand 18 to reliably lift only the uppermost workpiece W.

The separation unit 26 separates the uppermost workpiece W from the other workpieces W by way of the injection pressure of the air and the suction force. Therefore, even when the workpiece W is a non-magnetic body, it is possible for the robot hand 18 to lift only the uppermost workpiece W. In other words, regardless of the material of the workpiece W, it is possible for the robot hand 18 to lift only the uppermost workpiece W.

The one end of the connecting chain 50 is connected to the base end of the separation unit 26, and the other end of the connecting chain 50 is connected to the upper right side of the base frame 20. The vicinity of the one end of the connecting chain 50 is hung around the first sprocket 40. The vicinity of the other end of the connecting chain 50 is hung around the second sprocket 46 so as to suspend the second sprocket 46. The counter balancer 52 that reduces the weight acting on the separation unit 26 is provided at each of the end portions of the rotating shaft 48 of the second sprocket 46. Therefore, even if the weight of the separation unit 26 is large and the rigidity of the workpiece W is small, it is possible to support the separation unit 26 sufficiently from below without plastically deforming the vicinity of the edge of the workpiece W when the uppermost workpiece W is lifted. Further, even if the weight of the separation unit 26 is large, the impact when the separation unit 26 falls can be sufficiently reduced to prevent the workpieces W loaded in the loading area TA from being scratched.

Therefore, according to the present embodiment, regardless of the material of the workpiece W, it is possible for the robot hand 18 to stably lift only the uppermost workpiece W without damaging the workpiece W.

Further, since the assist unit 56 assists the falling operation due to the own weight of the separation unit 26, it is possible to reliably return the separation unit 26 to the position above the plurality of workpieces W loaded in the loading area TA. Further, since the contact roller 32 is rotatable around the horizontal axial center of rotation thereof, even if the end portion of the workpiece W interferes with the contact roller 32 when the workpiece W is lifted by the robot hand 18, the contact roller 32 does not hinder the workpiece W from being lifted.

Therefore, according to the present embodiment, it is possible for the supply robot 14 to sequentially and stably supply, to the press brake, the plurality of workpieces W loaded in the loading area TA.

Modified Example of the Present Embodiment

Figure 8:
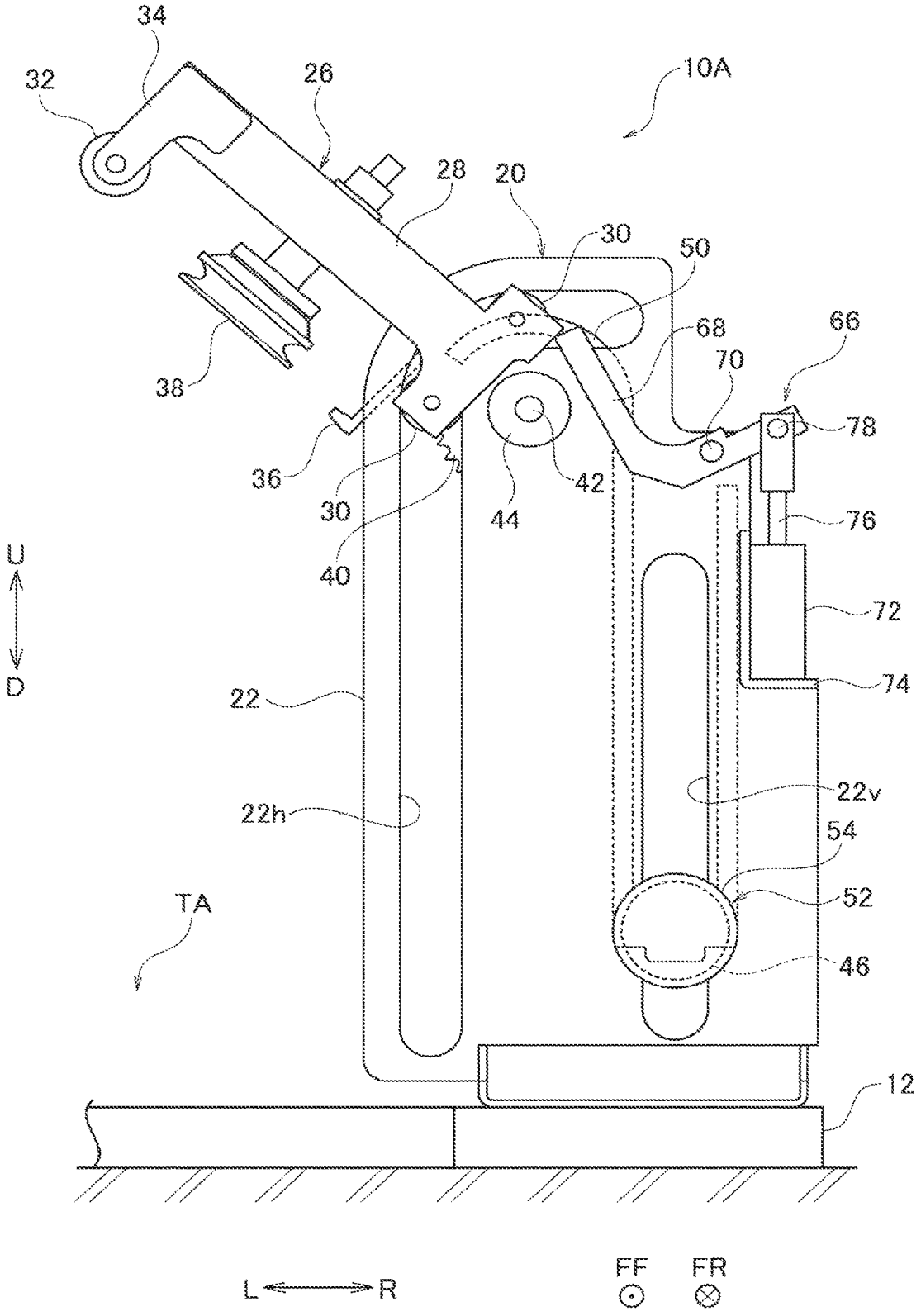
FIG. 8 is a front view of a single-sheet lifter according to a modified example (a state in which a second distal end of an operating link presses a unit main body from the right side).

As shown in FIG. 8, a single-sheet lifter 10A according to a modified example is a machine for lifting only the uppermost workpiece W among the plurality of the workpieces W loaded on the pallet P placed in the loading area TA, in the same manner as the single-sheet lifter 10 described above (see FIG. 3). The single-sheet lifter 10A includes an assist unit 66 having a configuration different from that of the assist unit 56 (see FIG. 3). Other configurations are the same as those of the single-sheet lifter 10. The specific configuration of the assist unit 66 will be described below. The same reference numerals will be given to the components that are the same as or equivalent to those of the single-sheet lifter 10 described above, and a detailed description thereof will be omitted.

An L-shaped operating link 68 is provided above the second guide elongated hole 22*v* in the support plate 22 on the front side so as to be swingable around a horizontal axial center of swinging (an axial center of a swinging shaft 70). On the right side of the second guide elongated hole 22*v*, an air cylinder 72 as an assist actuator is attached to the support plate 22 via a bracket 74. The air cylinder 72 includes an operation rod 76 that can move vertically. A rotatable connecting pin 78 is attached to the tip of the operation rod 76. The connecting pin 78 is connected to an elongated hole (not shown) formed at a first tip (one end) of the operating link 68. The assist unit 66 is configured such that a rotational force that promotes the falling operation of the separation unit 26 is applied to the unit main body 28 when the air cylinder 72 is driven to cause a second tip (the other end) of the operating link 68 to push the unit main body 28 from the right side.

Then, also in the modified example of the present embodiment, the same action and effect as the action and effect of the present embodiment described above are exhibited.

In the single-sheet lifter 10 (10A) according to the embodiment and modified example described above, the separation unit 26 is configured to go up following the lifting operation of the robot hand 18 and be retracted from above the loading area TA when the robot hand 18 (the workpiece suction lifter) of the supply robot 14 (the loading machine) sucks the surface of the uppermost workpiece W to lift the workpiece W. For this reason, the workpiece W sucked by the robot hand 18 of the supply robot 14 can be supplied to the press brake without being hindered by the separation unit 26. Since the separation unit 26 does not hinder the workpiece W from moving, it is possible to prevent the workpiece W from being damaged.

Further, the separation unit 26 includes the contact roller 32 (the contact member) that comes into contact with the surface of the uppermost workpiece W. For this reason, when the uppermost workpiece W is separated by means of at least one of the injection pressure of the air and the suction force, separation from the other workpieces W by lifting up the edge of the uppermost workpiece W can be easier. As a result, it is possible to reliably and stably lift only the upper workpiece W. Here, since the uppermost workpiece W is separated by means of at least one of the injection pressure of the air and the suction force, it is possible to reliably and stably lift only the uppermost workpiece W even when the workpiece W is a non-magnetic body, that is, when it is made of any raw material.

Further, the single-sheet lifter 10 (10A) also includes the counter balancer 52 that reduces the weight acting on the separation unit 26. For this reason, when the workpiece W is lifted by the robot hand 18, the weight of the separation unit 26 acting on the workpiece W can be alleviated by the counter balancer 52, and the deformation of the low-rigid workpiece W can be prevented. At the same time, the retracting operation of the separation unit 26 as the workpiece W goes up can be performed smoothly. Further, when the retracted separation unit 26 is caused to fall and return above the loaded workpieces W, the falling operation can be alleviated by the counter balancer 52. As a result, it is possible to prevent the workpiece W from being damaged.

The single-sheet lifter 10 (10A) according to the embodiment and modified example described above further include the first sprocket 40 (the first rotating wheel) and the second sprocket 46 (the second rotating wheel), and the linear connecting chain 50 (the connecting member) that are described above. The connecting chain 50 is hung around the first sprocket 40 and the second sprocket 46, the second sprocket 46 is suspended by the connecting chain 50, and the counter balancer 52 applies the downward force to the second sprocket 46. With this configuration, the weight of the separation unit 26 can be effectively reduced by the downward force applied to the second sprocket 46. Note that as described above, the first pulley may be used as the first rotating wheel, the second pulley may be used as the second rotating wheel, and the band-shaped connecting belt may be used as the connecting member.

Here, the separation unit 26 includes the bellows type suction pad 38 for sucking the surface in the vicinity of the edge of the uppermost workpiece W, For this reason, when the suction pad 38 is operated in a state in which the contact roller 32 (the contact member) is in contact with the surface of the uppermost workpiece W, it is possible to lift up the edge of the uppermost workpiece W using the contact roller 32 as a fulcrum. That is, it is possible to separate the uppermost workpiece W more reliably.

Here, the separation unit 26 includes the nozzle 36 for injecting the air toward the edge of the uppermost workpiece W. For this reason, by injecting the air from the nozzle 36, it is possible to lift up the edge of the uppermost workpiece W, using the contact roller 32 as a fulcrum, by means of the injection pressure thereof. That is, it is possible to separate the uppermost workpiece W more reliably.

Further, the single-sheet lifter 10 (10A) according to the embodiment and modified example described above further include the assist unit 56 (66) for assisting the falling operation due to the own weight of the retracted separation unit 26. For this reason, it is possible to return the separation unit 26 above the loaded workpieces W easily and quickly.

Furthermore, in the single-sheet lifter 10 (10A) according to the embodiment and modified example described above, the contact member is the contact roller 32 that is rotatable around the horizontal axial center of rotation. When the workpiece W is lifted by the robot hand 18, even if the workpiece W interferes with the contact roller 32 located at the tip of the separation unit 26, the contact roller 32 rotates so that the workpiece W is away from the contact roller 32 with the movement thereof not being hindered. Therefore, it is possible to prevent the workpiece W from being damaged, and the supply of the workpieces W is not hindered.

The present invention is not limited to the embodiment and modified example described above. For example, in the embodiment and modified example described above, the uppermost workpiece W is separated from the other workpieces W by using both the injection pressure of the air and the suction force. However, only at least one of the injection pressure of the air (the nozzle 36) and the suction force (the suction pad 38) may be used. Further, in lieu of the assist unit 56 (66) including the air cylinder 60 (72), an assist unit including an electric motor or a belt mechanism may be used. In this case, the assist unit assists the falling operation due to the own weight of the separation unit 26 by driving the electric motor or the belt mechanism.

The invention claimed is:

1. A system comprising a single-sheet lifter and a loading machine, wherein the single-sheet lifter comprises:

a base frame arranged in a vicinity of a loading area and extending vertically;

a separation unit provided to the base frame so as to be able to move up and down, the separation unit including a contact member that comes into contact with a surface of an uppermost workpiece among a plurality of the workpieces loaded in the loading area, the separation unit being configured to go up following a lifting operation of a workpiece suction lifter of the loading machine being provided separately from the single sheet lifter and be retracted from above the loading area when the workpiece suction lifter sucks the surface of the uppermost workpiece to lift the workpiece, and configured to separate the uppermost workpiece from other workpieces by means of at least one of an injection pressure of air and a suction force; and a counter balancer configured to reduce a weight acting on the separation unit.

2. The system according to claim 1, the single-sheet lifter further comprising:

a first rotating wheel provided to the base frame so as to be able to rotate;

a second rotating wheel provided to the base frame so as to be able to rotate and move up and down; and a linear or band-shaped connecting member including one end connected to the separation unit and another end connected to the base frame, the connecting member being hung around the first rotating wheel, and hung around the second rotating wheel so as to suspend the second rotating wheel, wherein the counter balancer is configured to apply a downward force to the second rotating wheel.

3. The system according to claim 1, wherein the separation unit includes a bellows type suction pad for sucking a surface in a vicinity of an edge of the uppermost workpiece, and is configured to lift up the edge of the uppermost workpiece using the contact member as a fulcrum when the suction pad executes a sucking operation in a state in which the contact member is in contact with the surface of the uppermost workpiece.

4. The system according to claim 1, wherein the separation unit includes a nozzle for injecting the air toward the edge of the uppermost workpiece.

5. The system according to claim 1, further comprising an assist unit for assisting a falling operation due to an own weight of the separation unit that is retracted from above the loading area.

6. The system according to claim 1, wherein the contact member is a contact roller rotatable around a horizontal axial center of rotation.

* * * * *